US005669519A

United States Patent [19]

Notz et al.

[11] Patent Number: 5,669,519

[45] Date of Patent: Sep. 23, 1997

[54] JUG HAVING A SECONDARY BOTTLE IN THE HANDLE OPENING

[75] Inventors: Robert R. Notz; Jerome P. Cappel; Gregory A. Zimmer, all of Cincinnati, Ohio

[73] Assignee: The Procter & Gamble Company, Cincinnati, Ohio

[21] Appl. No.: 623,307

[22] Filed: Mar. 28, 1996

[51] Int. Cl.[6] ..... B65D 23/12; B65D 69/00

[52] U.S. Cl. ..... 215/10; 206/504; 220/23.4; 220/23.83

[58] Field of Search ..... 215/6, 10; 220/23.83, 220/756, 23.4; 206/504

[56] References Cited

U.S. PATENT DOCUMENTS

| | | | |
|---|---|---|---|
| D. 302,658 | 8/1989 | Grinde | D9/375 |
| D. 303,087 | 8/1989 | Gendron | D9/378 |
| D. 307,392 | 4/1990 | Weckman | D9/376 |
| D. 310,958 | 10/1990 | Biesecker | D9/347 |
| D. 347,173 | 5/1994 | Bogstad et al. | D9/528 |
| D. 361,509 | 8/1995 | Dull et al. | D9/347 |
| D. 363,019 | 10/1995 | Arnold et al. | D9/347 |
| 2,274,973 | 3/1942 | Bryant | 215/6 X |
| 3,225,951 | 12/1965 | Poston et al. | 215/6 |
| 3,526,313 | 9/1970 | Kull et al. | 215/6 X |
| 4,460,423 | 7/1984 | Mednis | 215/10 |
| 4,776,972 | 10/1988 | Barrett | 252/90 |
| 4,925,066 | 5/1990 | Rosenbaum | 222/192 |
| 4,950,083 | 8/1990 | Bavaveas | 366/348 |
| 5,065,875 | 11/1991 | Balavich | 215/10 |
| 5,123,460 | 6/1992 | Reed | 141/95 |
| 5,135,116 | 8/1992 | Panzetti | 215/10 |
| 5,316,398 | 5/1994 | Chandaria et al. | 401/18 |

FOREIGN PATENT DOCUMENTS

| | | | |
|---|---|---|---|
| 2541580 | 3/1977 | Germany | 215/10 |

*Primary Examiner*—Sue A. Weaver
*Attorney, Agent, or Firm*—Ronald W. Kock

[57] ABSTRACT

A two container assembly comprises a first container for containing a fluid and a second container for containing a fluid. The first container has a handle and a handle opening, and the second container has a resilient sidewall, a top end and a bottom end. The second container is dimensioned to fit into the handle opening of the first container. The two container assembly has a means for snap-fitting the second container into the handle opening or frictionally engaging the second container in the handle opening. The means for snap-fitting preferably comprises a concave portion in the resilient sidewall of the second container. The concave portion has a shape that mates with a convex shaped portion of the handle. For example, the handle may have an oval cross-section. Also, the second container has a top-to-bottom axis which is substantially perpendicular to a top-to-bottom axis of the first container when the second container is located in the handle opening.

3 Claims, 2 Drawing Sheets

JUG HAVING A SECONDARY BOTTLE IN THE HANDLE OPENING

FIELD OF THE INVENTION

The present invention relates to plastic jugs having integral handles, and more particularly to such jugs wherein secondary bottles are packaged therewith. Even more particularly, the present invention relates to such jugs wherein the secondary bottle is capable of snap-fitting into the jug handle opening.

BACKGROUND OF THE INVENTION

Secondary bottles are packaged with larger bottles, for example in the laundry business for pretreating stains. The secondary bottle is typically small enough to handle conveniently as a squeezebottle, whereas the larger bottle is substantially rigid and serves as a reservoir for refilling the smaller bottle and as a source of washing machine detergent. Such package combinations have been marketed with the smaller bottle shrinkwrapped to the side of the larger bottle. The shrinkwrap approach is both expensive and packing line speed limiting. Shrinkwrap material is costly. The heat tunnel adds to manufacturing cost and is a relatively slow process. Having a smaller bottle hanging on the side of the larger bottle interferes with single-lining the larger bottles through the packing line and reduces efficiency.

What is needed is a small bottle/large bottle connecting arrangement which secures the small bottle in a position which does not interfere with large bottle single-lining and which avoids the need for shrinkwrapping and its resulting expenses.

SUMMARY OF THE INVENTION

In one aspect of the present invention a two container assembly comprises a first container for containing a fluid and a second container for containing a fluid. The first container has a handle and a handle opening, and the second container has a resilient sidewall, a top end and a bottom end. The resilient sidewall is dimensioned to fit into the handle opening of the first container when the resilient sidewall is partially flexed. The two container assembly has a means for snap-fitting the second container into the handle opening. The means for snap-fitting preferably comprises a concave portion in the resilient sidewall of the second container. The concave portion has a shape that mates with a convex shaped portion of the first container. For example, the handle may have an oval cross-section that mates with the concave portion of the resilient sidewall.

In another aspect of the present invention, a two container assembly comprises a first container for containing a fluid and a second container for containing a fluid. The first container has a handle, a handle opening, and a top-to-bottom axis. The second container has a top-to-bottom axis and is dimensioned to be inserted into the handle opening of the first container. Insertion of the second bottle into the handle opening occurs to a point where the second container engages the handle of the first bottle. The top end and the bottom end of the second container extend outwardly from opposite sides of the handle opening and the second container top-to-bottom axis is substantially perpendicular to the top-to-bottom axis of the first container.

The handle opening forms a finger hole for lifting and pouting from the first container when the second container is removed therefrom.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
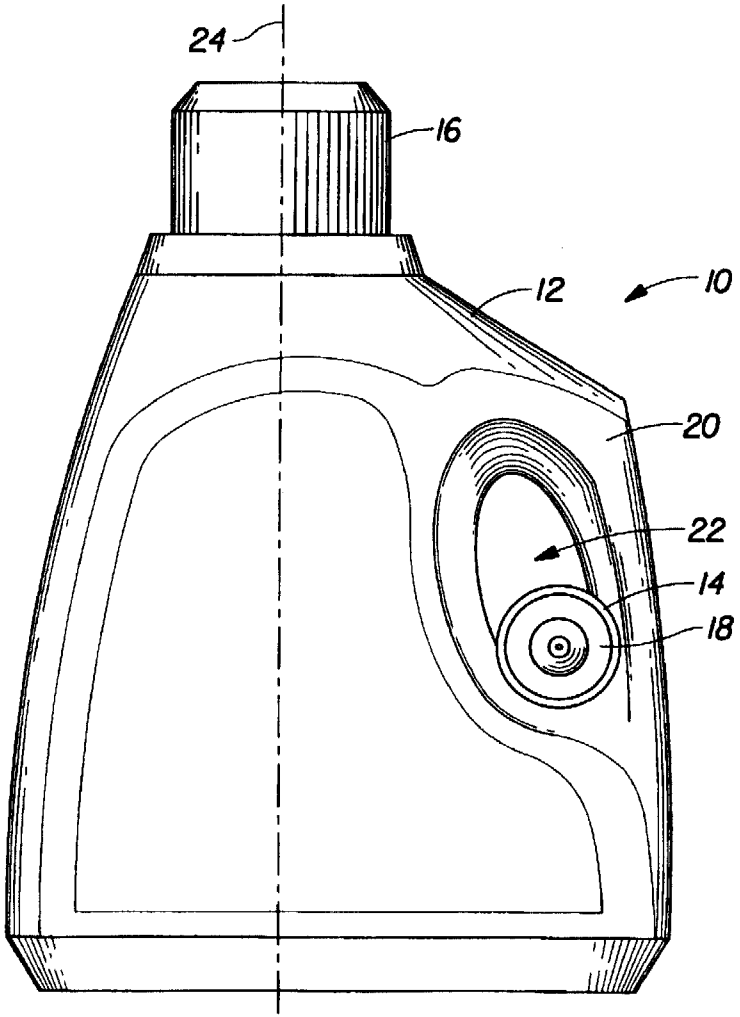
FIG. 1 is a front elevation view of a preferred embodiment of the present invention of a jug having a secondary container in the handle opening, disclosing a smaller bottle snapped into a portion of the handle opening of the jug.
Figure 2:
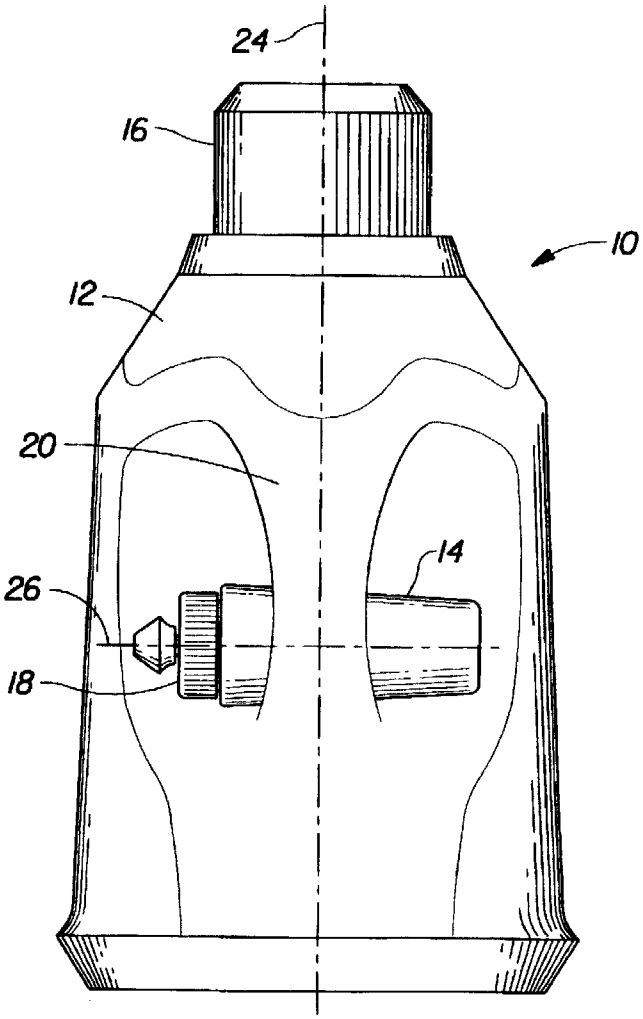
FIG. 2 is a right side elevation view thereof; showing the length of the smaller bottle being within the width of the jug when a top-to-bottom axis of the smaller bottle is substantially perpendicular to a top-to-bottom axis of the jug.

Referring now to the drawings, and more particularly to FIGS. 1 and 2, there is shown a first preferred embodiment of the present invention, which provides a jug having a secondary bottle in a handle opening to form a two container assembly, generally indicated as 10. Two container assembly 10 has a jug 12 and a squeezebottle 14. Jug 12 has a removable closure 16 and squeezebottle 14 has a removable dispensing closure 18. Jug 12 also has a handle 20 integrally formed in jug 12, forming a handle opening 22 into which a user's finger may be placed to pour fluid from jug 12. Jug 12 has a top-to-bottom axis 24 and squeezebottle 14 has a top-to-bottom axis 26. Squeezebottle 14 also has a means for snap-fitting squeezebottle 14 into handle opening 22, which is not shown in FIGS. 1 and 2.

Figure 3:
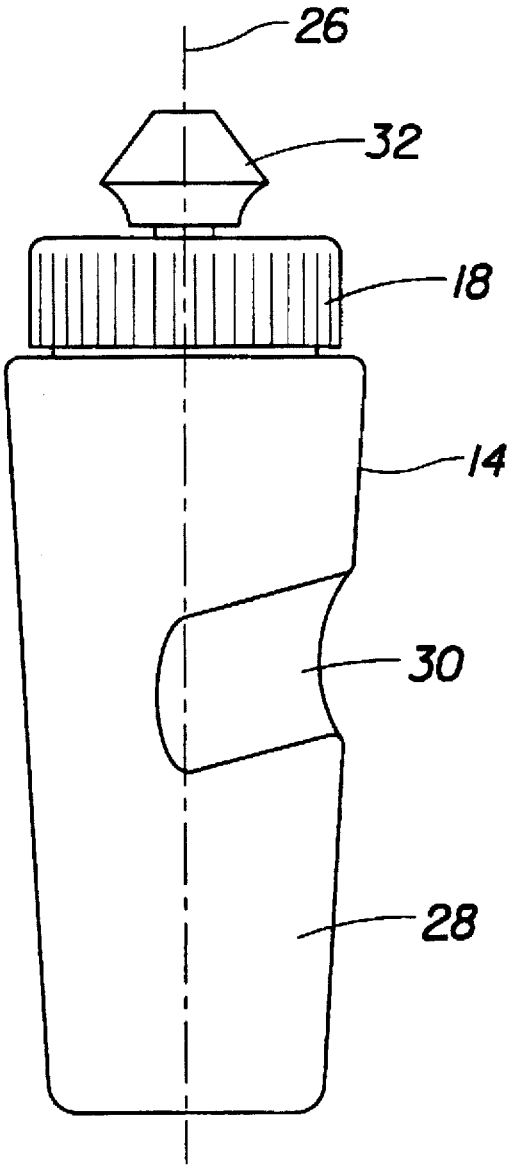
FIG. 3 is a perspective view of the smaller bottle of FIGS. 1 and 2 by itself, showing a concave portion in a resilient sidewall, which enables the smaller bottle to snap-fit into the handle opening of the rigid jug.

FIG. 3 shows squeezebottle 14 by itself. Squeezebottle 14 has resilient sidewall 28 and at least one concave portion 30 in sidewall 28. Because sidewall 28 is resilient so that pressure may be developed in squeezebottle 14 to dispense fluid therefrom, squeezebottle 14 may be snap-fit into handle opening 22 by partially deflecting sidewall 28 until concave portion 30 aligns with handle 20 within handle opening 22 and permits resilient sidewall 28 to return to its undeflected condition. FIG. 3 also shows removable dispensing closure 18 of squeezebottle 14 being a push-pull spout 32. Push-pull spout 32 is standard in laundry cleaning and dish cleaning packaging. When spout 32 is pulled outward along top-to-bottom axis 26, the fluid in squeezebottle 14 is free to flow out. When spout 32 is pressed inward, flow of fluid is stopped. The user of squeezebottle 14 manually operates spout 32 for dispensing fluid, such as when pretreating laundry by dabbing fluid from squeezebottle 14 onto unwanted spots on an article of clothing. Push-pull spout 32 may operate at an angle to top-to-bottom axis 26 of squeezebottle 14.

When squeezebottle 14 is packaged with jug 12 as a two container assembly, spout 32 is preferably closed if squeezebottle 14 contains fluid. If squeezebottle 14 does not contain fluid, spout 32 may be left in an open condition. Squeezebottle 12 may be shaped to partially fill handle opening 22 or to fully fill handle opening 22. Handle opening 22 may be shaped such that squeezebottle 14 must be snapped into the opening regardless of where in the opening it enters. Alternatively, handle opening 22 may be shaped to enable a rigid container to enter without being deflected. In the latter case, the rigid container may be first inserted and then moved preferably downward in handle opening 22 to engage handle 20 with sufficient friction to hold the rigid container in place. In this case, snap-fitting would not be required. Also, jug 12 may have a handle which is sufficiently resilient to provide the snap-fitting with the rigid secondary bottle.

FIG. 2 shows squeezebottle 14 having a length which is less than the width of jug 12. Although this dimensional relationship is preferable in order to prevent squeezebottle 14 interfering with single-line conveying of jug 12, such a relationship is not essential to the present invention. Top-to-bottom axis 26 of squeezebottle 14 is preferably perpendicular to top-to-bottom axis 24 of jug 12 because handle 20 is preferably parallel to jug top-to-bottom axis 24. This substantially perpendicular bottle axis relationship is also preferred but non-essential. Depending on the orientation of concave portion 30 in sidewall 28, squeezebottle 14 could have axis 26 somewhat skewed relative to jug axis 24.

Handle 20 of jug 12 is preferably oval in cross-section, having a convex shape where it surrounds handle opening 22, and concave portion 30 is preferably shaped to engage handle 20 snugly. However, alternative engagement arrangements are possible. For example, a concave portion could be formed in handle 20 which could engage a convex portion in sidewall 28 of squeezebottle 14.

In a particularly preferred embodiment of the present invention, jug 12 has an oval handle cross-section, having a width of about 1 inch (2.5 mm) and a thickness of about 0.75 inches (19.1 mm). Handle opening 22 is about 3 inches (76.2 mm) long by about 1.25 inches (31.8 mm) near the top of the handle, and by about 0.75 inches (19.1 mm) near the bottom of the handle. Squeezebottle 14 has a base cross-section which approximates that of handle opening 22, except that squeezebottle 14 is about 2.5 inches (63.5 mm) wide by about 1.3 inches (33 mm) at one end and 0.8 inches (20 mm) at the other end. Thus, squeezebottle sidewall 28 has an interference fit when it is inserted base-first into handle opening 22. From its base, squeezebottle 14 tapers outwardly toward its top end, increasing the interference fit. At about 2 inches (5 mm) from its base, sidewall 28 has a concave portion 30 about 0.3 inches (7.6 mm) deep and about 1 inch (2.5 mm) wide running all the way across one side of the sidewall and parallel to the squeezebottle base. Concave portion 30 is curved to match the oval shape of handle 20. Squeezebottle 14 may be inserted only base first into handle opening 22 and removed only in the opposite direction. Concave portion 30 fully engages handle 20 to a depth of 0.3 inches (7.6 mm) when squeezebottle 14 is snapped in place. Squeezebottle 14 is preferably used with at least two different sizes of detergent jugs, each having the same handle opening and handle shape.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A two container assembly comprising:

a) a first container for containing a fluid, said first container having a handle integrally formed therein, a handle opening, and a top-to-bottom axis, said handle opening being used as a finger hole for said first container; and b) a second container dimensioned to be inserted into said handle opening of said first container, said second container also having a top-to-bottom axis which is substantially perpendicular to said top-to-bottom axis of said first container when said second container is inserted into said handle opening, said second container only partially filling said handle opening so that said first container may be lifted by said handle opening with said second container therein.

2. The two container assembly of claim 1 wherein said two container assembly has a resilient sidewall, said resilient sidewall having a concave portion, and wherein said handle has an oval cross-section which mates with said concave portion of said resilient sidewall for snap-fitting said second container into said handle opening of said first container.

3. A two container assembly comprising:

a) a first container for containing a fluid, said first container having a handle integrally formed therein, a handle opening, and a top-to-bottom axis, said handle opening being used as a finger hole for said first container; and b) a second container for containing a fluid, said second container having a resilient sidewall, a top end and a bottom end, said resilient sidewall being dimensioned to be inserted into said handle opening of said first container as said resilient sidewall is partially flexed, insertion occurring to a point where a concave portion in said second container engages said handle, said engagement resulting in a snap-fit, said top end and said bottom end of said second container extending outwardly from opposite sides of said handle opening, and said second container having a top-to-bottom axis being substantially perpendicular to said top-to-bottom axis of said first container when said second container is snap-fit into said handle opening, said second container only partially filling said handle opening so that said first container may be lifted by said handle opening with said second container therein.

* * * * *